US007878174B2

(12) United States Patent
Nishimura et al.

(10) Patent No.: US 7,878,174 B2
(45) Date of Patent: Feb. 1, 2011

(54) FUEL-SUPPLYING STRUCTURE FOR A V-TYPE MULTI-CYLINDER ENGINE, AND ENGINE INCORPORATING SAME

(75) Inventors: Shin Nishimura, Saitama (JP); Tetsunori Iwamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 12/284,497

(22) Filed: Sep. 23, 2008

(65) Prior Publication Data

US 2009/0084350 A1 Apr. 2, 2009

(30) Foreign Application Priority Data

Sep. 29, 2007 (JP) ..... 2007-256961

(51) Int. Cl.
*F02D 9/10* (2006.01)

(52) U.S. Cl. ..... 123/336; 123/468; 123/54.4

(58) Field of Classification Search ..... 123/336, 123/468, 469, 184.31, 54.4, 54.5, 54.6, 54.7, 123/54.8, 195 A, 198 C
See application file for complete search history.

(56) References Cited

U.S. PATENT DOCUMENTS 6,105,562 A * 8/2000 Akagi et al. ..... 123/580
6,334,430 B1 * 1/2002 Itabashi ..... 123/336
7,556,021 B2 * 7/2009 Toriumi et al. ..... 123/469
2004/0244768 A1 * 12/2004 Udono ..... 123/336
2005/0229902 A1 * 10/2005 Taguchi ..... 123/336
2007/0272205 A1 * 11/2007 Kondo ..... 123/336
2008/0078355 A1 * 4/2008 Maehara et al. ..... 123/399

FOREIGN PATENT DOCUMENTS

JP 10-157682 A 6/1998
JP 11-093802 4/1999

* cited by examiner

*Primary Examiner*—Stephen K Cronin
*Assistant Examiner*—Anthony L Bacon
(74) *Attorney, Agent, or Firm*—Carrier Blackman & Associates, P.C.; Joseph P. Carrier; William D. Blackman

(57) ABSTRACT

In a V-type multi-cylinder engine, a first fuel supply conduit is connected to fuel-injection valves in a first throttle body group corresponding to the first bank, and a second fuel supply conduit is connected to fuel injection valves in a second throttle body group corresponding to the second bank. A pair of first and second side plates connect adjacent ends of the first and second throttle body groups together. A distance between respective throttle bodies located in two ends of the first throttle body group is set shorter than a comparable distance between the throttle bodies located in two ends of the second throttle body group. A joint part for connectively receiving the fuel hose is provided at an end of the first fuel supply conduit in a way that the joint part is arranged between the two side plates.

20 Claims, 8 Drawing Sheets

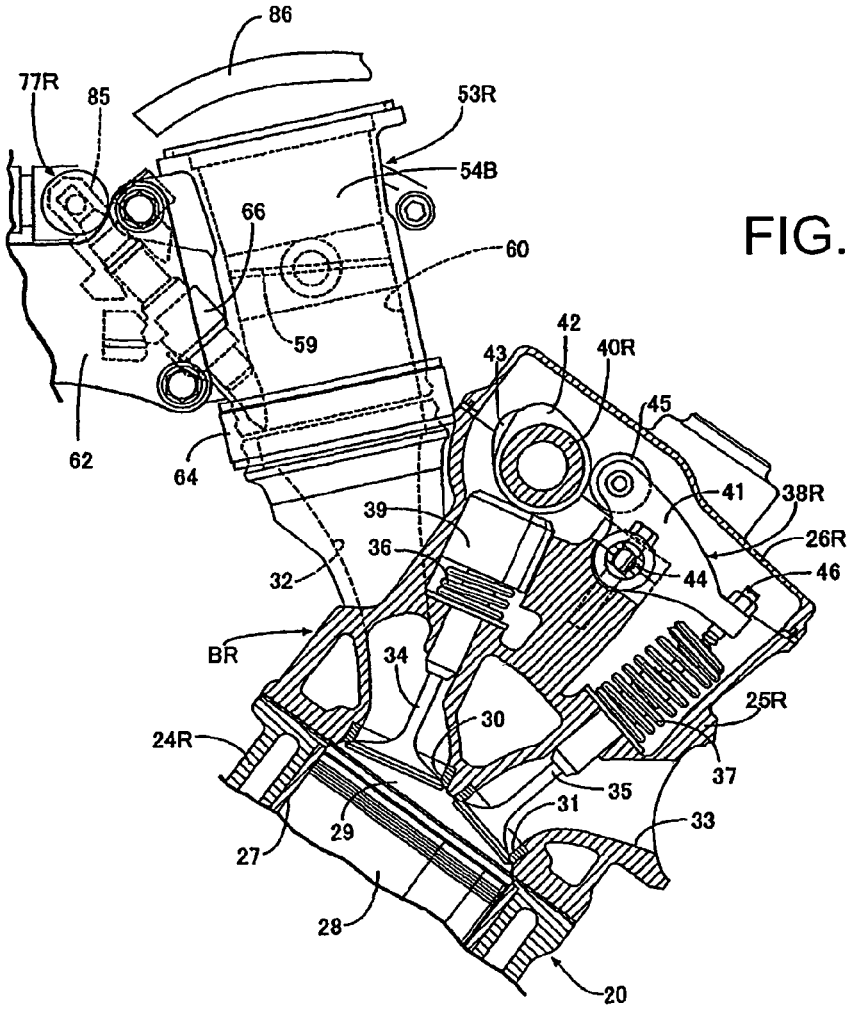
FIG. 4
FIG. 6
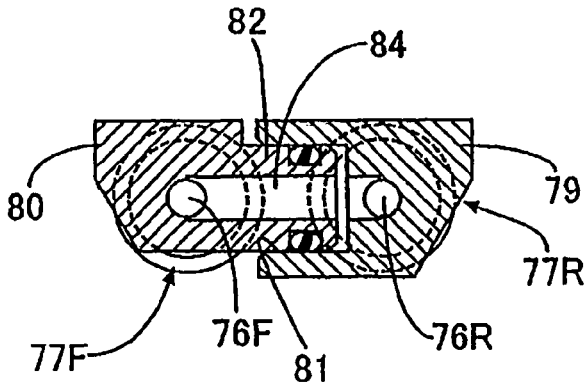

FUEL-SUPPLYING STRUCTURE FOR A V-TYPE MULTI-CYLINDER ENGINE, AND ENGINE INCORPORATING SAME

CROSS-REFERENCE TO RELATED APPLICATIONS

The present application claims priority under 35 USC §119 based on Japanese patent application No. 2007-256961, filed on Sep. 29, 2007. The entire subject matter of this priority document is incorporated by reference herein.

BACKGROUND OF THE INVENTION

1. Field of the Invention

The present invention relates to a fuel delivery system for an internal combustion engine. More particularly, the present invention relates to a fuel delivery system including first and second banks, first and second throttle body groups, first and second fuel supply conduits, as well as a pair of side plates. The first and second banks each include multiple cylinders arranged in a cylinder arrangement direction, and further arranged in a V shape.

2. Description of the Background Art

Japanese Patent Application No. Hei. 11-93802 describes a known V-type multi-cylinder engine. In the case V-type multi-cylinder engine of this reference, two fuel supply passages are arranged respectively corresponding to the two throttle body groups of the two banks, in a way that the fuel supply passages extend in a cylinder arrangement direction, and a joint part to which to connect a fuel hose is provided to an end portion of each of fuel supply conduits forming the respective fuel supply passages. Each fuel supply passage supplies fuel to a plurality of fuel injection valves respectively annexed to throttle bodies in a corresponding one of the throttle body groups.

In the case of the type of V-type multi-cylinder engine disclosed by Japanese Patent Application No. Hei. 11-93802, the joint part is arranged in a way that the joint part juts out from one of the paired side plates respectively for connecting the ends, in a cylinder arrangement direction, of one throttle body group to the ends, in a cylinder arrangement direction, of the other throttle body group. For this reason, for the purpose of securing the durability of the joint part, the arrangement of the other component parts needs to be decided in order that interference between the joint part and the other component parts can be avoided. This reduces the arrangement freedom. The reduced arrangement freedom makes it difficult to arrange the other component parts around the V-type multi-cylinder engine functionally and compactly.

SUMMARY OF THE INVENTION

As noted above, the present invention relates to a fuel delivery system including first and second banks, first and second throttle body groups, first and second fuel supply conduits, and a pair of side plates. The fuel delivery system according to the invention is provided for a V-type multi-cylinder internal combustion engine including first and second banks, each including multiple cylinders arranged in a cylinder arrangement direction.

An object of the present invention is to provide a fuel supplying structure in a V-type multi-cylinder engine which has an increased freedom in arranging the other component parts around the V-type multi-cylinder engine, and which is compact.

In the first throttle body group, multiple throttle bodies corresponding to the first bank are arranged side-by-side in the cylinder arrangement direction. In the second throttle body group, multiple throttle bodies corresponding to the second bank are arranged side-by-side in the cylinder arrangement direction. Each throttle body includes a throttle bore, and a fuel injection valve is annexed to the throttle body.

The first fuel supply conduit forms a first fuel supply passage which is connected to the fuel injection valves belonging to the first throttle body group, and which extends in the cylinder arrangement direction. The second fuel supply conduit forms a second fuel supply passage which is connected to the fuel injection valves belonging to the second throttle body group, and which extends parallel to the first fuel supply passage. The paired side plates connect the ends of the first throttle body group to the ends of the second throttle group in the cylinder arrangement direction, respectively.

In a first aspect of the present invention, the fuel-supplying structure is characterized in that a distance between the throttle bores in the respective throttle bodies located at the two ends of the first throttle body in the cylinder arrangement direction is set shorter than the distance between the throttle bores of the respective throttle bodies located at the two ends of the second throttle body in the cylinder arrangement direction, and characterized in that, out of the first and second fuel supply conduits connected to each other in order that the first and second fuel supply passages communicate with each other, a joint part to which to connect a fuel hose communicating with the first fuel line is provided to an end of a first fuel supply conduit corresponding to the first throttle body in a way that the joint part is arranged between the two side plates.

In a second aspect of the present invention, the fuel supplying structure with the configuration according to the first aspect is further characterized in that: the joint part is formed in a way that the joint part is detachably connected to the fuel hose extending in the longitudinal direction of the first fuel supply passage by an insertion/detachment operation of the fuel hose; and out of the two side plates, the side plate located in a side where the joint part is arranged is formed in a way that the joint part is exposed to the outside when viewed in the longitudinal direction of the first fuel supply passage.

In a third aspect of the present invention, the fuel supplying structure with the configuration according to the first aspect is further characterized in that the first and second fuel supply conduits are connected to each other at their middle portions respectively in the longitudinal directions of the first and second fuel supply conduits.

In a fourth aspect of the present invention, the fuel supplying structure with the configuration according to the first aspect is further characterized in that throttle valves are placed in the throttle bodies, to be arranged inside the throttle bores formed in the throttle bodies, respectively; and an electric motor for generating power for driving at least the throttle valves in the respective throttle bodies in the second throttle body group to open and close is placed in an end portion of the throttle body group in the cylinder arrangement direction.

In a fifth aspect of the present invention, the fuel supplying structure with the configuration according to the first aspect is further characterized in that: throttle valves to be arranged inside the throttle bores formed in the throttle bodies are placed in the throttle bodies, respectively; and an electric motor for generating power for driving at least the throttle valves in the respective throttle bodies in the first throttle body group to open and close is placed in an end portion of the first throttle body group in the cylinder arrangement direction.

It should be noted that a rear bank BR according to an example of the present invention corresponds to the first bank of the present invention whereas a front bank BF according to the example thereof corresponds to the second bank of the present invention.

The invention according to the first aspect makes it possible to avoid interference between the joint part and the other component parts, and to increase freedom in arranging the other component parts, as well as thus to arrange the other component members around the V-type multi-cylinder engine easily, functionally and compactly. This is because the first and second fuel supply conduits are connected to each other, and because the joint part provided to an end portion of the first fuel supply conduit is arranged between the two side plates.

The invention according to the second aspect makes it easy to detachably connect the fuel hose to the joint part by an insertion/detachment operation of the fuel hose, and thus to increase the productivity and ease of maintenance. This is because, out of the two side plates, a side plate located in the side where the joint part is arranged is formed in the way that the joint part is exposed to the outside when viewed in the longitudinal direction of the first fuel supply passage.

The invention according to the third aspect makes it possible to protect the connecting part between the first and second fuel supply conduits easily. This is because the two fuel supply conduits are connected to each other in their middle portions in their longitudinal directions.

The invention according to the fourth aspect makes it possible to increase freedom in laying out the fuel hose connected to the joint part. This is because the electric motor is arranged in the second throttle body group whereas the joint part is arranged in the first throttle body group.

The invention according to the fifth aspect makes it possible to arrange the electric motor and the joint part together in the side of the first throttle body group compactly, and thus to increase freedom in arranging the other component parts which are designed to be arranged around the two throttle body groups.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4 is a magnified cross-sectional detail view of the chief section taken along the line 4-4 of FIG. 3.

FIG. 6 is a magnified cross-sectional detail view of the chief section shown in FIG. 5.

DETAILED DESCRIPTION OF ILLUSTRATIVE EMBODIMENTS

Descriptions will be provided herein of selected illustrative embodiments of the present invention as examples of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art. In the following detailed description, relative positional terms such as "front", rear", "upper", "lower", "right side" and "left side" correspond to those directions considered from the vantage point of a vehicle operator, seated on the driver's seat and facing forwardly.

Figure 1:
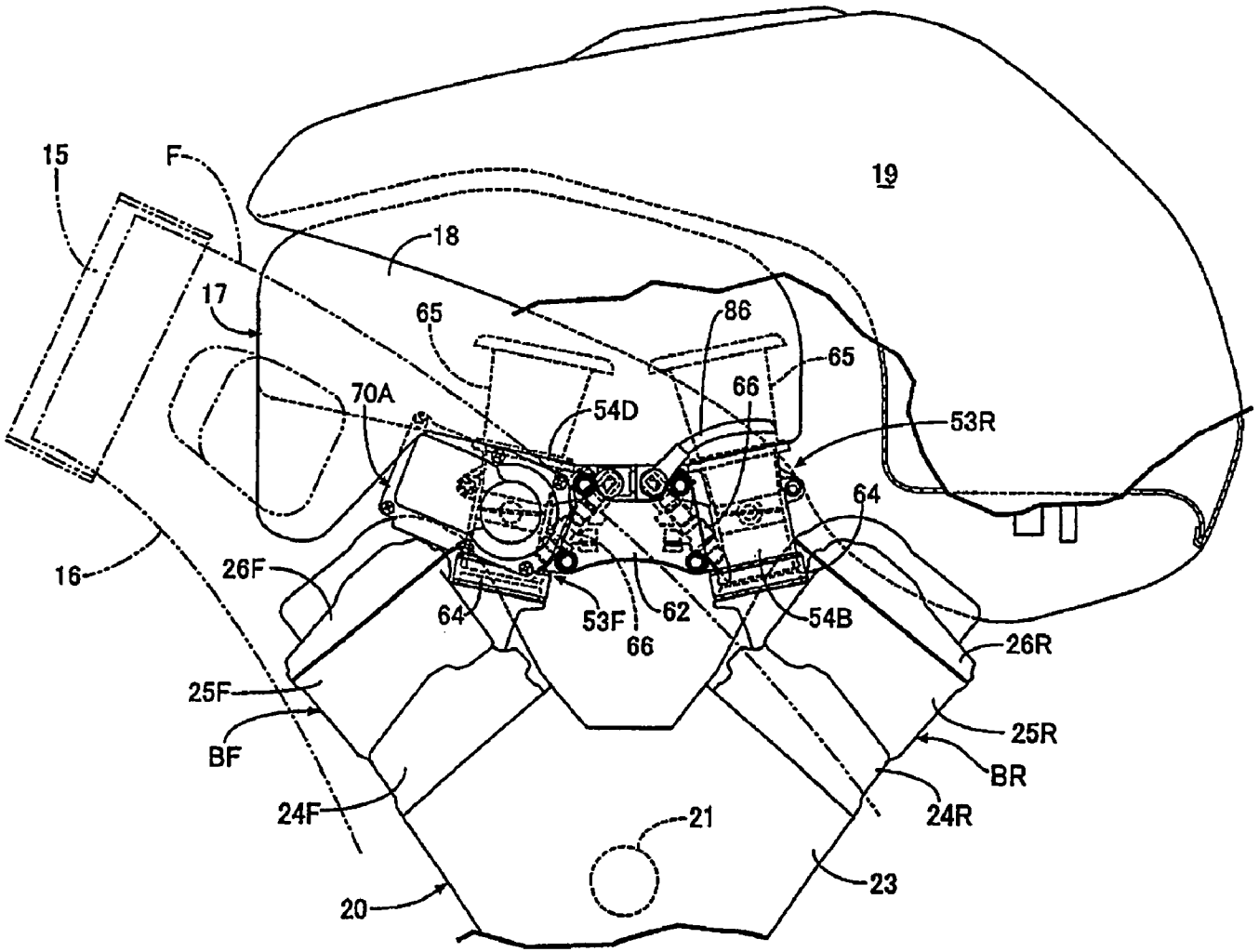
FIG. 1 is a vertical cross-sectional left side view of a chief section of a motorcycle incorporating a fuel-supplying structure according to a first illustrative embodiment of the present invention.

FIGS. 1 through 6 show a chief section of a motorcycle incorporating a fuel-supplying structure according to a first illustrative embodiment of the present invention. FIG. 1 is a vertical cross-sectional side view of a central section of a motorcycle, which is obtained when viewed from the left side of the motorcycle.

A vehicle body frame F of the motorcycle in FIG. 1 includes a head pipe 15, disposed at the front end of the vehicle body frame F, and paired right and left main frames 16, each respectively extending downward from the head pipe 15 to the rear thereof. An air cleaner housing 18 of an air cleaner 17 is supported above the two main frames 16. A fuel tank 19 is disposed above and covering the air cleaner housing 18. In addition, an engine main body 20, which is a V-type 4 cylinder engine, is mounted on the vehicle body frame F below the air cleaner 17. The engine body 20 is arranged with an axis of a crankshaft 21 thereof oriented transversely to a longitudinal center line of the motorcycle.

Figure 2:
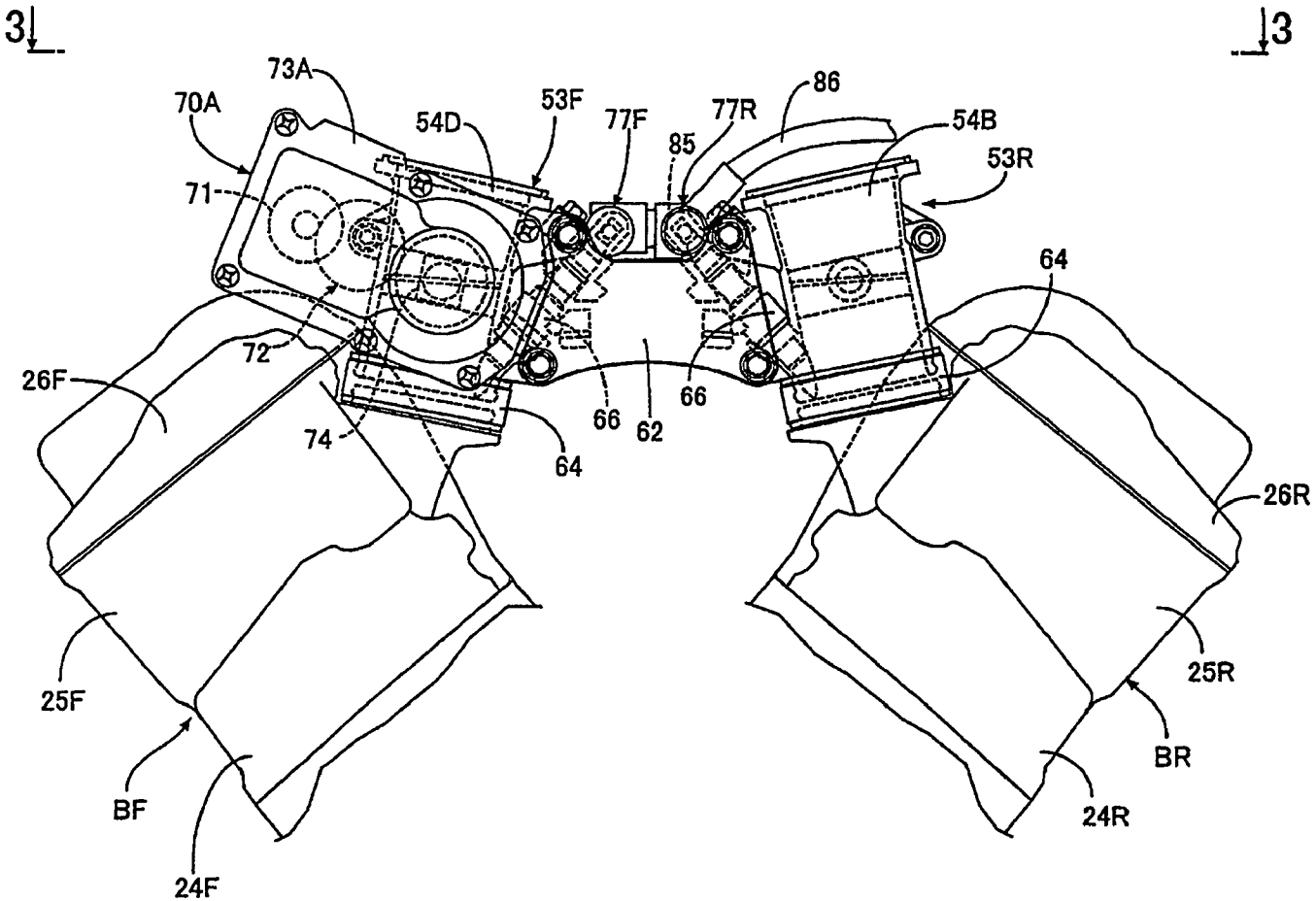
FIG. 2 is a magnified detail view of part of the chief section of FIG. 1.
Figure 3:
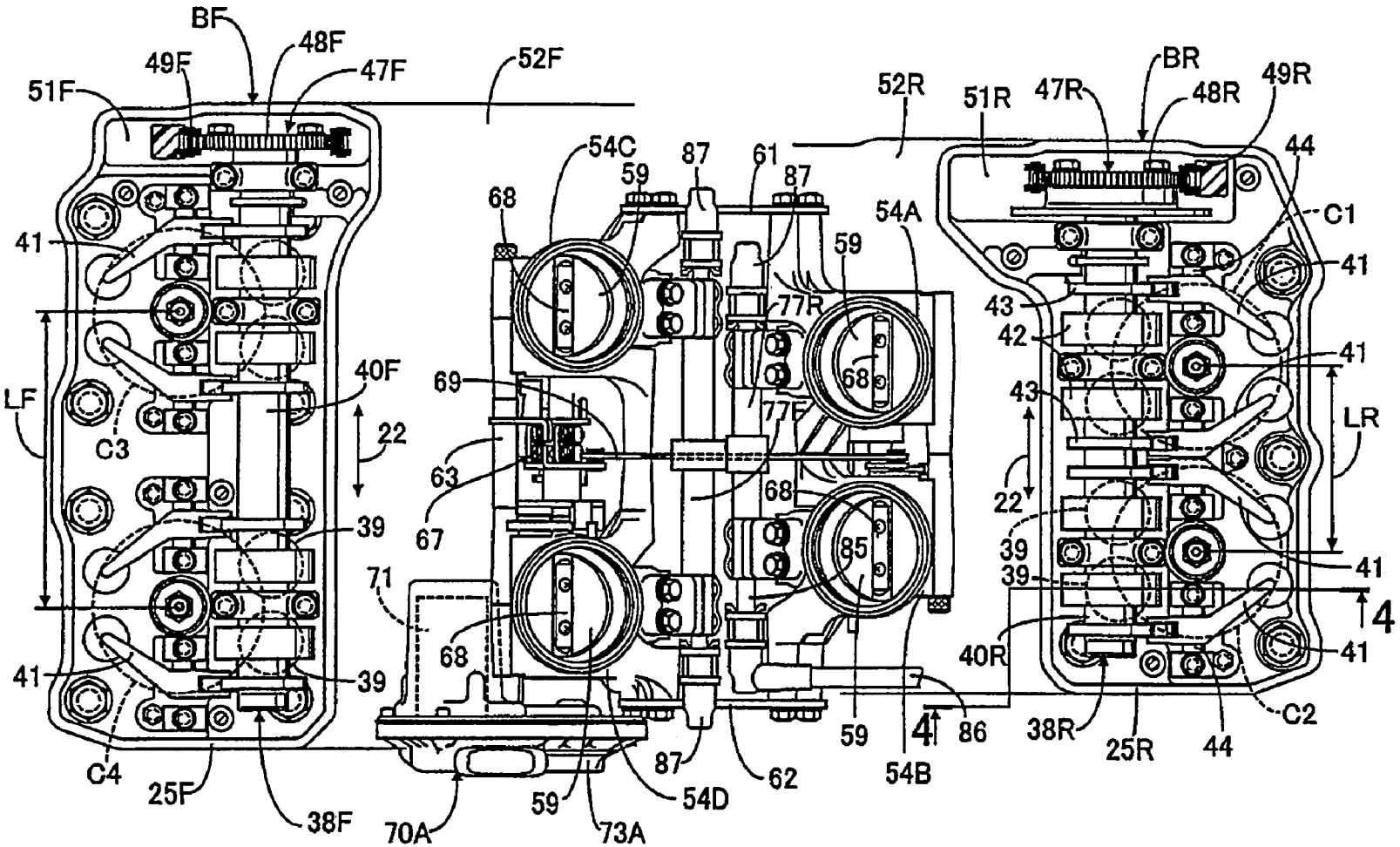
FIG. 3 is an auxiliary plan view of the chief section taken along the line 3-3 of FIG. 2, from which a head cover is omitted for purposes of illustration.

As shown in FIGS. 2 and 3 together, the engine main body 20 includes a rear bank BR as a first bank and a front bank BF as a second bank. The rear bank BR and the front bank BF are separate from each other in the front-rear direction of the motorcycle, and arranged in a V shape. The rear bank BR includes two cylinders C1 and C2 arranged side-by-side in the right-left direction of the vehicle body frame F, and the front bank BF includes two cylinders C3 and C4 arranged side-by-side in the right-left direction of the vehicle body frame F. In other words, the rear bank BR includes first and second cylinders C1 and C2 arranged side-by-side in a cylinder arrangement direction 22 which is equal to the right-left direction of the vehicle body frame F, and the front bank BF includes a third and fourth cylinders C3 and C4 arranged side-by-side in the cylinder arrangement direction 22.

The lower portions respectively of the rear bank BR and the front bank BF are commonly connected to a crankcase 23, which rotatably supports the crankshaft 21 with its axis extending in the width direction of the vehicle body frame F, as noted. Accordingly, it will be understood that the axis of the crankshaft 21 extends in the cylinder arrangement direction 22.

The rear bank BR includes a cylinder block 24R, which inclines upwardly to the rear and which is connected to the crankcase 23; a cylinder head 25R connected to the cylinder block 24R; and a head cover 26R connected to the cylinder head 25R. Similarly, the front bank BF includes a cylinder block 24F, which inclines upwardly to the front and which is connected to the crankcase 23; a cylinder head 25F connected to the cylinder block 24F; and a head cover 26F connected to the cylinder head 25F.

As shown in FIG. 3, the interval LR between the central axes of the first and second cylinders C1 and C2 in the rear bank RF is set shorter than the interval LF between the central axes of the third and fourth cylinders C3 and C4 in the front bank BF. Accordingly, the width of the rear bank BR, in the axis direction of the crankshaft 21, is narrower than the corresponding width of the front bank BF, so the rear bank BR is hidden behind the front bank BF when the engine is viewed from the front.

For each of the cylinders C1 and C2, as shown in FIG. 4, a combustion chamber 29 is formed between the cylinder block 24R and the cylinder head 25R of the rear bank BR. The top of a piston 28, slidably fitted into a cylinder bore 27 provided in the cylinder block 24R faces toward the combustion chamber 29. Similarly, for each of the cylinders C3 and C4, as shown in FIG. 4, a combustion chamber 29 is formed between the cylinder block 24F and the cylinder head 25F in the front bank BF. The top of the piston 28, slidably fitted into the cylinder bore 27 of the cylinder block 24F faces toward the combustion chamber 29.

In the cylinder head 25R of the rear bank BR, an intake valve port 30 and an exhaust valve port 31 which are capable of communicating with the combustion camber 29 are provided in pairs to each of the cylinders C1 and C2. Likewise, in the cylinder head 25F in the front bank BF, an intake valve port 30 and an exhaust valve port 31 which are capable of communicating with the combustion camber 29 are provided in pairs to each of the cylinders C3 and C4. For the cylinders C1 and C2, an intake port 32 communicating commonly with the intake valve port 30 thus paired is open to the front side of the cylinder head 25R in a way that the intake port 32 faces a V-shaped space created between the rear bank BR and the front bank BF. Likewise for the cylinders C3 and C4, an intake port 32 communicating commonly with the intake valve port 30 thus paired is open to the rear side of the cylinder head 25F in a way that the intake port 32 faces a V-shaped space created between the rear bank BR and the front bank BF. For the cylinders C1 and C2, an exhaust port 33 communicating commonly with the exhaust valve port 31 thus paired is open to the rear side of the cylinder head 25R. Likewise for the cylinders C3 and C4, an exhaust port 33 communicating commonly with the exhaust valve port 31 thus paired is open to the front side of the cylinder head 25F.

In addition, intake valves 34, for opening and closing the respective intake valve ports 30, as well as exhaust valves 35 for opening and closing the respective exhaust valve ports 31, are placed in each of the cylinder heads 25R and 25F in a way that the intake valves 34 and the exhaust valves 35 are capable of opening and closing. Each intake valve 34 is biased by a valve spring 36 in a closing direction, and each exhaust valve 35 is biased by a valve spring 37 in a closing direction.

A first valve train 38R for driving the intake valve 34 and the exhaust valve 35 to open and close is housed between the cylinder head 25R and the head cover 26R in the rear bank BR. The intake valve 34 and the exhaust valve 35 are placed in pairs in each of the first and second cylinders C1 and C2 in the cylinder head 25R in the way that the intake valve 34 and the exhaust valve 35 are capable of opening and closing.

The first valve train 38R includes: valve lifters 39 each of which is formed in the shape of a closed-end cylinder with its top end being closed, and each of which is slidably fitted into the cylinder head 25R in a way that the top end of a corresponding one of the intake valves 34 abuts on the top end inner surface of the valve lifter 39; a rear camshaft 40R arranged above the valve lifters 39; and rocker arms 41 for driving the respective exhaust valves 35 to open and close while the rocker arms 41 swing through driving coupled with the rotation of the rear camshaft 40R.

The rear camshaft 40R has an axis which extends in parallel to the axis of the crankshaft 21, and the rear camshaft 40R is rotatably supported by the cylinder head 25R. Intake cams 42 provided to this rear camshaft 40R abut on the top end outer surfaces of the valve lifters 39, respectively. In addition, each of the rocker arms 41 has an axis which extends parallel to the rear camshaft 40R. For each exhaust valve 35, the rocker arm 41 is swingably supported by a corresponding one of the respective rocker shafts 44, which are all fixedly supported by the cylinder head 25R. A roller 45, in rolling contact with a corresponding one of the exhaust cams 43 provided to the rear camshaft 40R, is pivotally supported by an end portion of each rocker arm 41. A tappet screw 46 is screwed to the other end portion of each rocker arm 41, in a way that an advancement and retreat positions of the tappet screw 46 are capable of being controlled by rotation thereof. Each tappet screw 46 abuts on the top end of a corresponding exhaust valve 35.

A second valve train 38F housed between the cylinder head 25F and the head cover 26F in the front bank BF includes: valve lifters 39 slidably fitted into the cylinder head 25F; a front camshaft 40F arranged above the valve lifters 39; and rocker arms 41 for driving the respective exhaust valves 35 to open and close while the rocker arms 41 swing through driving coupled with the rotation of the camshaft 45F. The second valve train 38F is configured in a manner similar to that described above in connection with the first valve train 38R.

As shown in FIG. 3, a first timing transmission mechanism 47R is provided between the rear camshaft 40R in the first valve train 38R and the crankshaft 21, and a second timing transmission mechanism 47F is provided between the front camshaft 40F in the second valve train 38F and the crankshaft 21.

The first timing transmission mechanism 47R is configured by looping an endless cam chain 49R around a driven timing sprocket (camshaft sprocket) 48R, fixed to an end of the rear camshaft 40R in the first valve train 38R, and a crank sprocket (not illustrated) provided to the crankshaft 21. In the present example, the end of the rear camshaft 40R is the right end of the rear camshaft 40R when the engine main body 20 is mounted on the motorcycle. The first timing transmission mechanism 47R transmits the rotary power of the crankshaft 21 to the rear camshaft 40R, while decelerating the rotary speed by half due to the relative sizes of the respective sprockets.

The second timing transmission mechanism 47F is configured by looping an endless cam chain 49F around a driven sprocket 48F, fixed to an end of the front camshaft 40F in the second valve train 38F, and a driving sprocket (not illustrated) provided to the crankshaft 21. In the present example, the end of the front camshaft 40F carrying the sprocket is the right end thereof when the engine main body 20 is mounted on the motorcycle. The second timing transmission mechanism 47F transmits the rotary power of the crankshaft 21 to the front camshaft 40F while decelerating the rotary speed by half.

A first timing chain chamber 51R, in which the cam chain 49R of the first timing transmission mechanism 47R is allowed to run, is formed in the cylinder block 24R and the cylinder head 25R of the rear bank BR. A second timing chain chamber 51F, in which the cam chain 49F of the second timing transmission mechanism 47F is allowed to run, is formed in the cylinder block 24F and the cylinder head 25F of the front bank BF. In addition, a swelling-out part 52R, which swells out frontwardly, is formed in an end portion of each of the cylinder block 24R and the cylinder head 25R in the rear bank BR, the end portion being that of the side where the first timing transmission mechanism 47R is arranged.

In the present example, the end portion is the right end portion of each of the cylinder block 24R and the cylinder head 25R. A swelling-out part 52F, which swells out rearwardly, is formed in an end portion of each of the cylinder block 24F and the cylinder head 25F in the front bank BF, the end portion being that of the side where the second timing transmission mechanism 47F is arranged. In the present example, the end portion is the right end portion of each of the cylinder block 24F and the cylinder head 25F.

Figure 5:
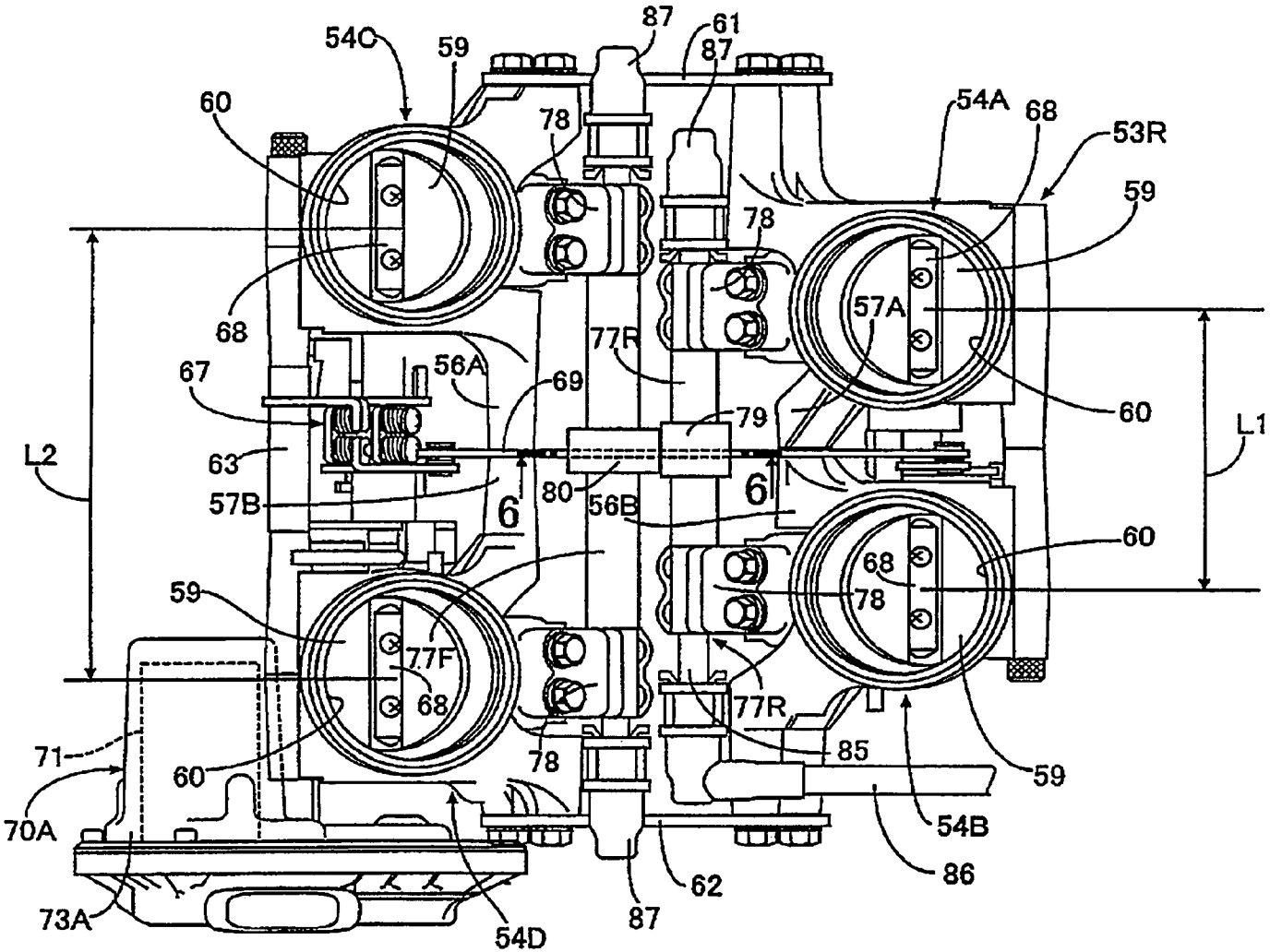
FIG. 5 is a magnified detail view of the chief section shown in FIG. 3.

As shown in FIGS. 1 and 5, a first throttle body group 53R for the rear bank BR, and a second throttle body group 53F for the front bank BF are arranged in a space between the rear bank BR and the front bank BF.

The first throttle body group 53R includes the first and second throttle bodies 54A and 54B arranged side-by-side in the cylinder arrangement direction 22. The first and second throttle bodies 54A and 54B respectively correspond to the first and second cylinders C1 and C2 arranged side-by-side in the cylinder arrangement direction 22 in the rear bank BR. The second throttle body group 53F includes the third and fourth throttle bodies 54C and 54D arranged side-by-side in the cylinder arrangement direction 22. The third and fourth throttle bodies 54C and 54D respectively correspond to the third and fourth cylinders C3 and C4 arranged side-by-side in the cylinder arrangement direction 22 in the front bank BF.

Each of the first to fourth throttle bodies 54A to 54D has a respective throttle bore 60. Throttle valves (throttle plates) 59 for controlling the openings of the respective throttle bores 60 are rotatably supported in the throttle bodies 54A to 54D, respectively.

The first throttle body group 53R is configured by connecting the first throttle body 54A to the second throttle body 54B. The second throttle body group 53F is configured by connecting the third throttle body 54C to the fourth throttle body 54D. The distance L1 between the centers of the respective throttle bores 60 in the first and second throttle bodies 54A and 54B in the first throttle body group 53R is substantially equal to the interval LR between the central axes of the first and second cylinders C1 and C2 in the rear bank BR. The distance L2 between the centers of the respective throttle bores 60 in the third and fourth throttle bodies 54C and 54D in the second throttle body group 53F is substantially equal to the interval LF between the central axes of the third and fourth cylinders C3 and C4 in the front bank BF.

In other words, the distance L1, in the cylinder arrangement direction 22 between the centers respectively of the throttle bores 60 in the throttle bodies 54A and 54B located in the two ends of the first throttle body group 53R, is set shorter than the distance L2 in the cylinder arrangement direction 22 between the centers of the throttle bores 60 in the throttle bodies 54C and 54D located in the two ends of the second throttle body group 53F.

In addition, the two ends of the first throttle body group 53R are respectively connected to the two ends of the second throttle body group 53F by the paired side plates 61 and 62, which each extend in a direction substantially orthogonal to the cylinder arrangement direction 22. In the present example, the first throttle body 54A in the first throttle body group 53R and the third throttle body 54C in the second throttle body group 53F are connected to each other by the first side plate 61, while the second throttle body 54B in the first throttle body group 53R and the fourth throttle body 54D in the second throttle body group 53F are connected to each other by the second side plate 62. Furthermore, the third and fourth throttle bodies 54C and 54D in the second throttle body group 53F are connected to each other with a spacer 63 interposed therebetween.

The throttle bodies 54A and 54B in the first throttle body group 53R are connected to the cylinder head 25R with an insulator gasket 64 interposed therebetween, and the throttle bodies 54C and 54D in the second throttle body group 53F are connected to the cylinder head 25F with an insulator gasket 64 interposed therebetween. Thereby, the downstream ends respectively of the throttle bores 60 of the throttle bodies 54A and 54B communicate with the intake port 32 of the cylinder head 25R, and the downstream ends respectively of the throttle bores 60 of the throttle bodies 54C and 54D communicate with the intake port 32 of the cylinder head 25F.

Moreover, an air intake funnel 65 is connected to each of the respective throttle bodies 54A to 54D, with a downstream end of the air intake funnel attached to and in fluid communication with the upstream end of the associated throttle bore 60. The upstream ends of the respective intake air funnels 65 protrude into a filtered air chamber in the air cleaner housing 18.

The valve shafts 68 of the two respective throttle valves 59 in the second throttle body group 53F are arranged coaxially, and are linked and connected to each other with a linkage mechanism 67. In addition, the valve shafts 68 of the two respective throttle valves 59 in the first throttle body group 53R are coaxially linked and connected to each other. The linkage mechanism 67 is linked and connected to the valve shafts 68 of the two respective throttle valves 59 in the first throttle body group 53R with a link 69 interposed therebetween. In other words, the throttle valves 59 in the first and second throttle body groups 53R and 53F open and close through their respective linkages.

The throttle valves 59 in the first and second throttle body groups 53R and 53F are driven to open and close by throttle driving mechanism 70A. This throttle driving mechanism 70A is configured of: an electric motor 71 for generating power for driving the throttle valves 59 to open and close; and a transmission mechanism 72 for decelerating the power coming from the electric motor 71, and thereafter for transmitting the resultant power to one of the valve shafts 68. The throttle driving mechanism 70A is housed in a casing 73A.

The throttle driving mechanism 70A is placed in the side of the second throttle body group 53F, and is arranged in a side which is opposite to the side where the second timing transmission mechanism 47F is located. The casing 73A is attached to the fourth throttle body 54D in the second throttle body group 53F.

The electric motor 71 has an axis which extends in the cylinder arrangement direction 22. As shown in FIG. 3, the electric motor 71 is arranged between the fourth throttle body 54D and the cylinder head 25F in a plan view.

The transmission mechanism 72 is a reduction gear mechanism composed of multiple gears meshing with one another. The transmission mechanism 72 is interposed between the valve shaft 68 of the fourth throttle body 54D in the second throttle body group 53F and the electric motor 71. In addition, an opening sensor 74 (see FIG. 2) for detecting the amount of rotation of the valve shaft 68 of the fourth throttle body 54D, or the opening of each throttle valve 59, is housed in the casing 73A.

A first fuel supply conduit 77R is connected to a fuel injection valve 66 of the first throttle body group 53R, and a second fuel supply conduit 77F is connected to a fuel injection valve 66 of the second throttle body group 53F. The first and second fuel supply conduits 77R and 77F are arranged parallel to each other extending in the cylinder arrangement direction 22. Supporting members 78 for supporting these fuel supply conduits 77R and 77F are attached to each of the throttle bodies 54A to 54D.

As shown best in FIG. 6, the middle portions respectively of the first and second fuel supply conduits 77R and 77F in their longitudinal directions are connected to each other. Specifically, a connecting tube part 79 which includes a fitting concave part 81, and which is open to the side of the second fuel supply passage 76F, is provided to the middle portion of the first fuel supply passage 76R. A connecting tube part 80 including a fitting protrusion part 82 which fluid-tightly fits into the fitting concave 81 is provided to the middle portion of the second fuel supply conduit 77F. Thus, with the fitting protrusion part 82 being fluid-tightly fitted into the fitting concave part 81, the connecting tube parts 79 and 80 together form a communicating line 84. The communicating line 84 causes the first fuel supply passage 76R which extends in the cylinder arrangement direction 22, and which is formed in the first fuel supply conduit 77R, to communicate with the second fuel supply passage 76F which extends in the cylinder arrangement direction 22, and which is formed in the second fuel supply conduit 77F. As depicted, the fuel supplying structure including the first and second fuel supply conduits 77R, 77F, and the connecting tube parts 79 80 is substantially "H-shaped" when viewed in plan, is bounded in the cylinder arrangement direction by the first and second side plates 61, 62, and is bounded in a direction perpendicular to the cylinder arrangement direction by the first and second throttle body groups 53R, 53F.

As shown in FIGS. 3 and 5, a joint part 85, to which a fuel hose 86 is connected, is provided to an end of the first fuel supply conduit 77R corresponding to the first throttle body group 53R. In the present example, the left end of the first fuel supply conduit 77R receives the fuel hose 86 at the joint part 85. This joint part 85 is arranged between the paired right and left side plates 61 and 62 which connect respective side portions of the first and second throttle body groups 53R and 53F.

In addition, the joint part 85 is configured to be detachably connected to the fuel hose 86 extending in the longitudinal direction of the first fuel supply conduit 77R by an insertion/detachment operation of the fuel hose 86. Out of the two side plates 61 and 62, the side plate 62 located in the side where the joint part 85 is arranged is formed in a way that the joint part 85 is exposed to the outside when viewed in the longitudinal direction of the first fuel supply conduit 77R. In the present example, the side plate 62 is formed in a way that a part of the top portion of the side plate 62 is recessed.

Furthermore, the right end of the first fuel supply conduit 77R opposite the joint part 85, and the two ends of the second fuel supply conduit 77F are each closed fluid-tightly with a respective cap 87.

Next, descriptions will be provided for operations of the first example. The distance L1 between the throttle bores 60 of the respective throttle bodies 54A and 54B located in the two ends of the first throttle body group 53R in the cylinder arrangement direction 22 is set shorter than the distance L2 between the throttle bores 60 of the respective throttle bodies 54C and 54D located in the two ends of the second throttle body group 53F in the cylinder arrangement direction 22. In addition, out of the first and second fuel supply conduits 77R and 77F connected to each other in order that the first and second fuel supply passages 76R and 76F can communicate with each other, the first fuel supply conduit 77R corresponds to the first throttle body group 53R. The joint part 85, to which the fuel hose 86 is connected, communicating with the first fuel supply passage 76R is provided to an end of the first fuel supply conduit 77R in the way that the joint part 85 is arranged between the paired right and left side plates 61 and 62 for connecting the first and second throttle body groups 53R and 53F to each other.

As a result, the fuel delivery structure according to the first embodiment makes it possible to avoid interference between the joint part 85 and the other component parts, and thus to increase freedom in arranging those component parts, as well as accordingly to arrange those component parts around the V-type multi-cylinder engine easily, functionally and compactly.

In addition, the example makes it easy to detachably connect the fuel hose 86 to the joint part 85 with an insertion/detachment operation of the fuel hose 86, and thus makes it possible to increase the productivity and maintenancebility. This is because the joint part 85 is formed in a way that the joint part 85 is detachably connected to the fuel hose 86 extending in the longitudinal direction of the first fuel supply passage 76R with an insertion/detachment operation of the fuel hose 86, and concurrently because, out of the two side plates 61 and 62, the side plate 62 located in the same side as the joint part 85 is arranged is formed in a way that the joint part 85 is exposed to the outside when viewed in the longitudinal direction of the first fuel supply passage 76R.

Furthermore, the example makes it possible to easily protect the connecting part between the two fuel supply conduit 77R and 77F. This is because the first and second fuel supply conduits 77R and 77F are connected to each other at their center portions in the longitudinal directions of the fuel supply conduits 77R and 77F.

In addition, the present example makes it possible to increase freedom in laying out the fuel hose 86 connected to the joint part 85. This is because the electric motor 71 for generating power for driving at least the throttle valves 59 of the respective throttle bodies 54C and 54D in the second throttle body group 53F (or the throttle valves 59 of the respective throttle bodies 54A to 54D in the first and second throttle body groups 53R and 53F In the present example) to open and close is placed in an end portion of the second throttle body group 53F in the cylinder arrangement direction 22 with the distance L2 between the throttle bores 60 respectively of the third and fourth throttle bodies 54C and 54D, which are adjacent each other, in the second throttle body group 53F being longer than the distance between the throttle bores 60 respectively of the first and second throttle bodies 54A and 54B in the first throttle body group 53R. This placement scheme allows the joint part 85 to be arranged in the side of the first throttle body group 53R, and the electric motor 71 to be arranged in the side of the second throttle body group 53F.

Furthermore, the present example makes it possible to place the electric motor 71 close to the cylinder head 25F to the maximum possible extent with no consideration given to interference which otherwise occur between the electric motor 71 and the second timing transmission mechanism 47F, and thus to construct the fuel supplying structure compactly. This is because the electric motor 71 as the throttle driving mechanism 70A is arranged in the side which is opposite to the side where the second timing transmission mechanism 47F is located in the axis direction of the crankshaft 21, so that the electric motor 71 is arranged between the fourth throttle body 54D and the cylinder head 25F in a plan view.

Figure 7:
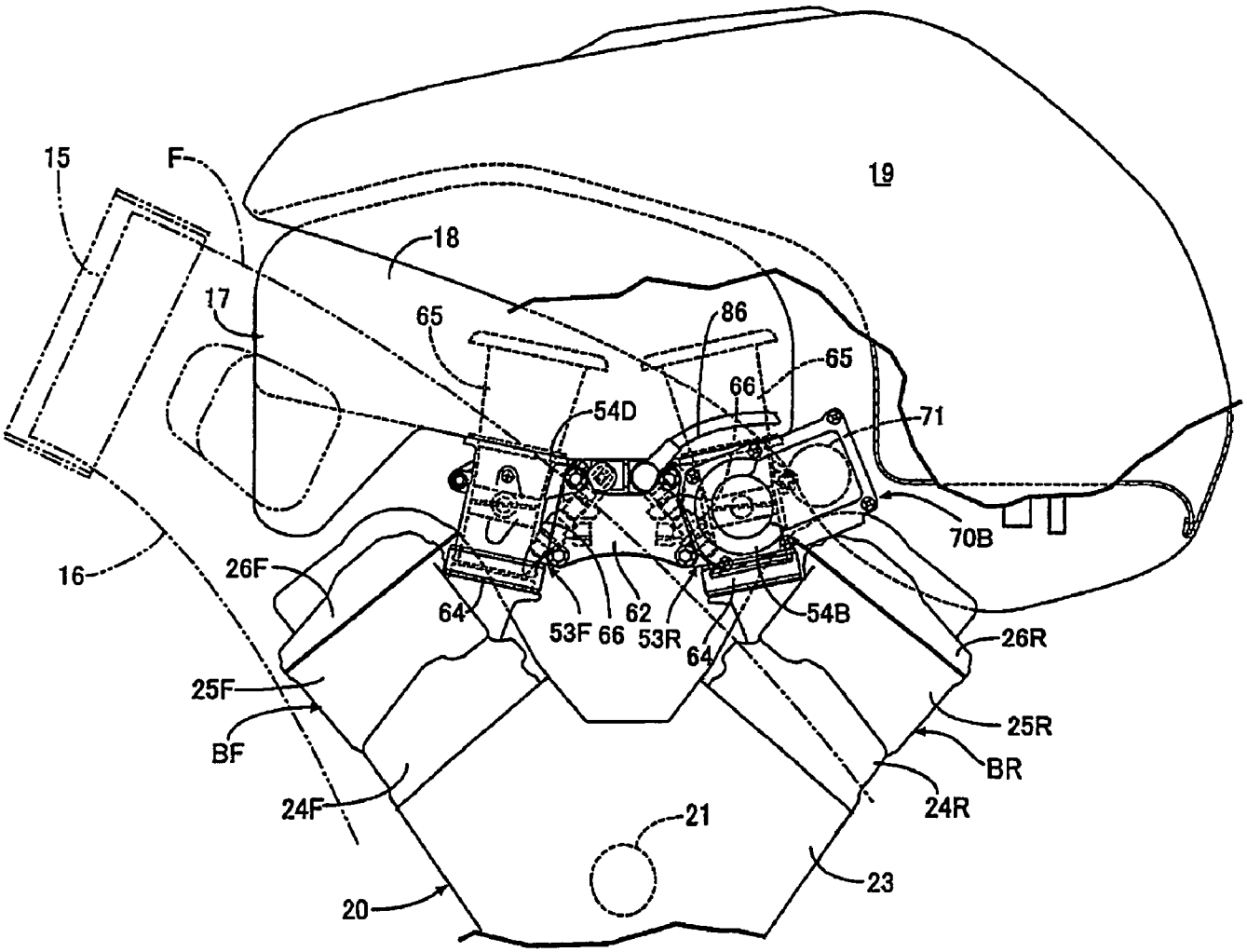
FIG. 7 is a vertical cross-sectional left side view of a chief section of a motorcycle incorporating a fuel-supplying structure according to a second illustrative embodiment of the present invention.
Figure 8:
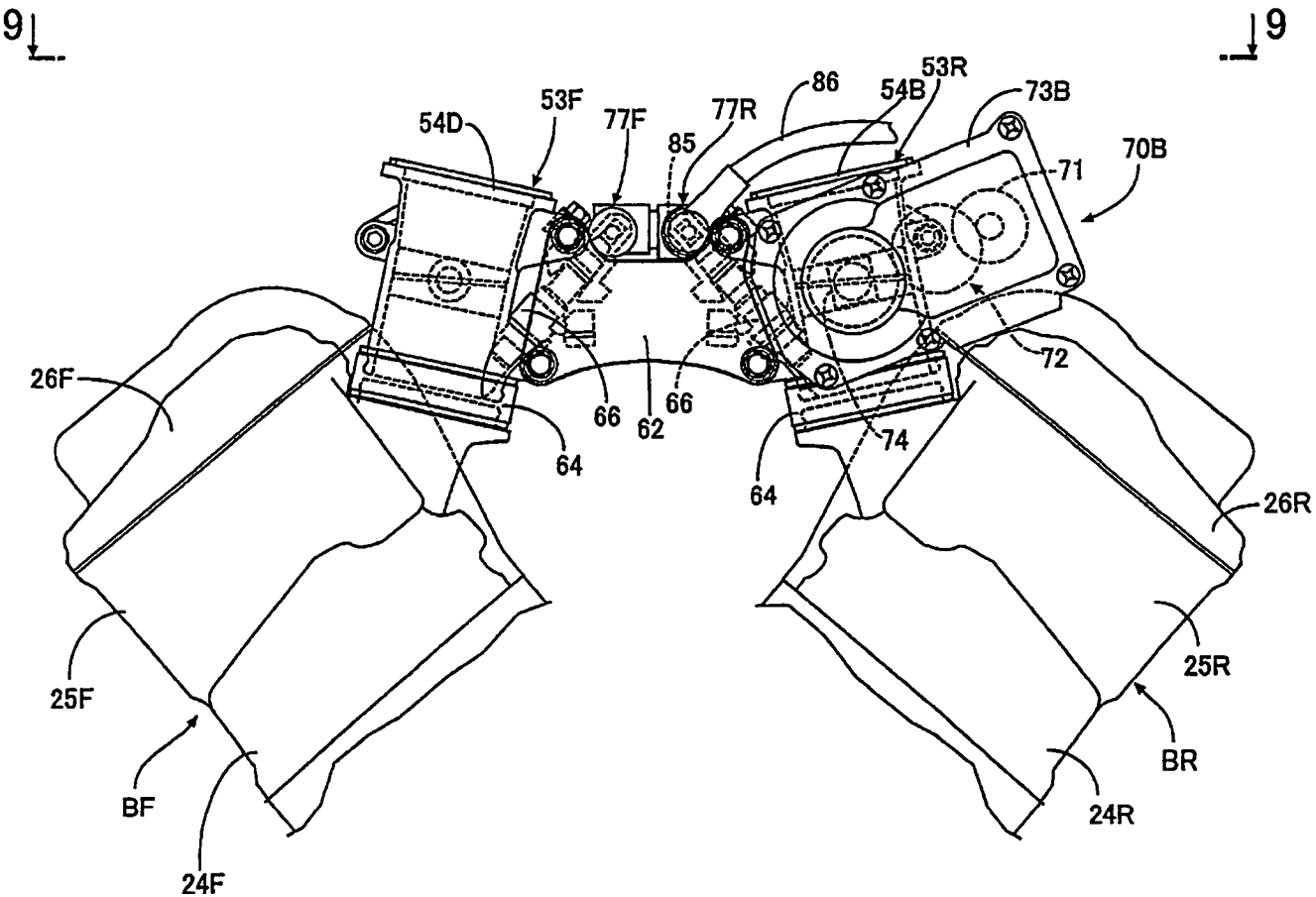
FIG. 8 is a magnified view of the chief section shown in FIG. 7.
Figure 9:
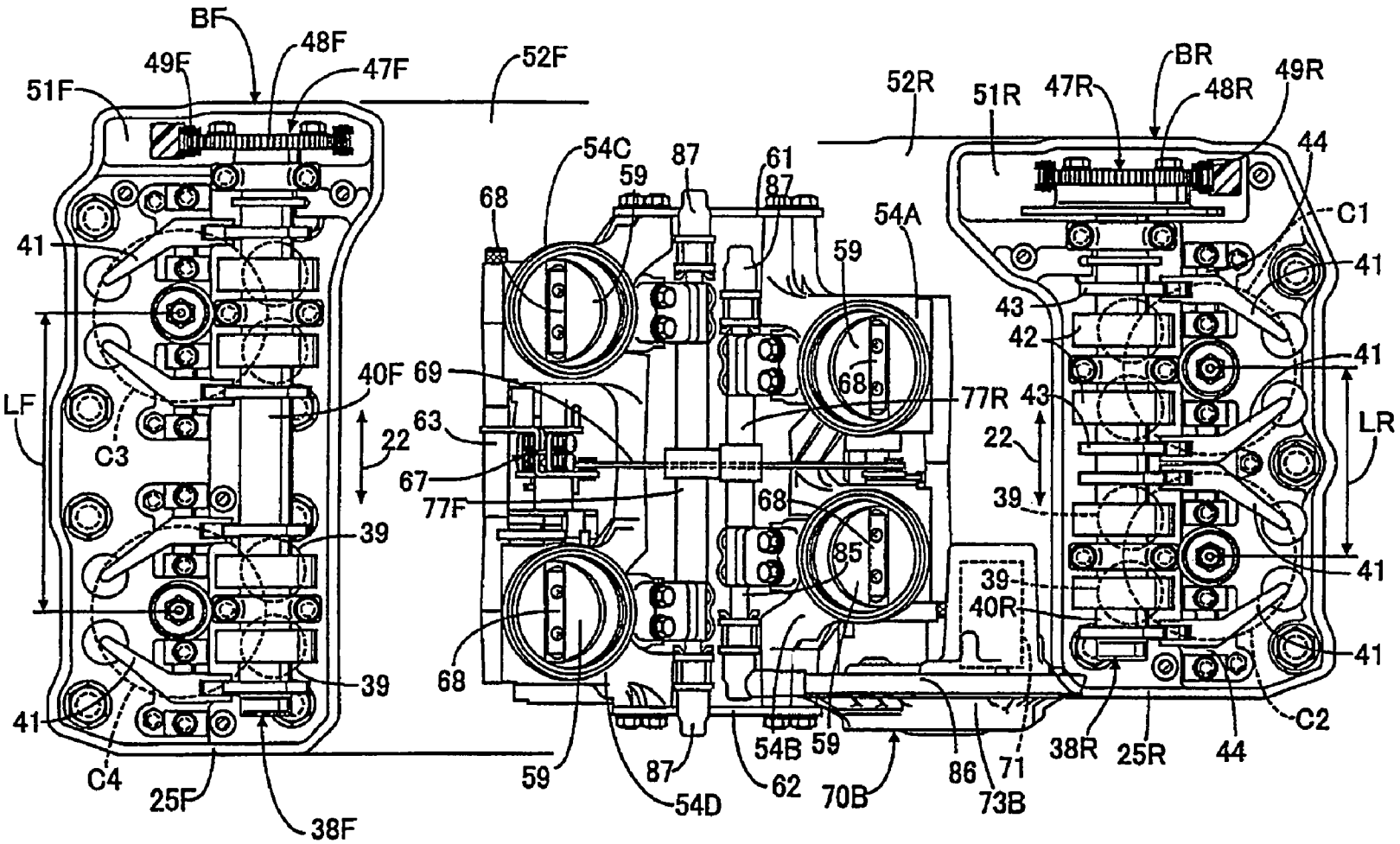
FIG. 9 is an auxiliary plan view of the chief section taken along the line 9-9 of FIG. 8, from which a head cover is omitted for purposes of illustration.

FIGS. 7 to 9 show a second embodiment of the present invention. FIG. 7 is a vertical cross-sectional view of a chief section of the motorcycle, which is obtained when viewed from the left. FIG. 8 is a magnified view of the chief section shown in FIG. 7. FIG. 9 is an auxiliary plan view of the chief section with the illustration of the head cover being omitted, which is taken along the 9-9 line of FIG. 8.

Parts corresponding to those in the first example are only illustrated with the same reference numerals being given to the parts, and the detailed descriptions for the parts will be omitted.

The throttle valves 59 of the first and second throttle groups 53R and 53F, respectively, are driven to open and close by a throttle driving mechanism 70B. This throttle driving mechanism 70B is configured of: the electric motor 71 for generating power for driving the throttle valves 59 to open and close; and a transmission mechanism 72 for decelerating the power of the electric motor 71, and for transmitting the resultant power to one of the valve shafts 68. The throttle driving mechanism 70B is housed in a casing 73B.

The throttle driving mechanism 70B is placed in the side of the first throttle body group 53R, and is thus arranged in the side which is opposite to the side where the first timing transmission mechanism 47R. The casing 73B is attached to the second throttle body 54B in the first throttle body group 53R.

The electric motor 71 has its axis which extends in the cylinder arrangement direction. As shown in FIG. 9, the electric motor 71 is arranged between the second throttle body 54B and the cylinder head 25R in a plan view. In addition, as shown in FIG. 7, the electric motor 71 is arranged under a space created between the air cleaner housing 18 of the air cleaner 17 and the fuel tank 19.

The second example makes it possible to effectively arrange the electric motor 71 and the transmission mechanism 72 under a space created by narrowing down the interval between the first and second throttle bodies 54A and 54B in the first throttle body group 53R. This is because the electric motor 71 and the transmission mechanism 72 are arranged in the first throttle body group 53R with the distance L1 between the throttle bores 60 respectively of the first and second throttle bodies 54A and 54B in the first throttle body group 53B being shorter than the distance between the throttle bores 60 respectively of the third and fourth throttle bodies 54C and 54D in the second throttle body group 53F.

Furthermore, the second example makes it possible to place the electric motor 71 close to the cylinder head 25R to the maximum possible extent with no consideration being given to interference which would otherwise occur between the electric motor 71 and the first timing transmission mechanism 47R, and thus to construct the fuel supplying structure compactly. This is because the electric motor 71 as the throttle driving mechanism 70B is arranged in the side which is opposite to the side where the first timing transmission mechanism 47R is located in the axis direction of the crankshaft 21, so that the electric motor 71 is arranged between the second throttle body 54B and the cylinder head 25R in a plan view.

The present invention has been described citing its example. However, the present invention is not limited to the example. It is possible to apply various design modifications to the present invention without departing from the present invention as recited in the scope of claims.

What is claimed is:

1. In a multi-cylinder engine including first and second banks, first and second throttle body groups, as well as a pair of side plates;

each of the first and second banks including a plurality of cylinders arranged in a cylinder arrangement direction, the first and second banks cooperating to define a V-shape;

each of the first and second throttle body groups comprising a plurality of throttle bodies arranged side-by-side in the cylinder arrangement direction; each of the throttle bodies including a throttle bore, and a fuel injection valve operatively associated with each of the throttle bodies, respectively;

the improvement comprising a substantially H-shaped fuel supplying structure bounded in the cylinder arrangement direction by the first and second side plates and bounded in a perpendicular direction with respect to the cylinder arrangement direction by the first and second throttle body groups, including:

a first fuel supply conduit extending in the cylinder arrangement direction and connecting to the fuel injection valves of the first throttle body group;

a second fuel supply conduit extending in parallel to the first fuel supply passage and connecting to the fuel injection valves of the second throttle body group; the paired side plates respectively connecting ends of the first throttle body group to corresponding ends of the second throttle group;

a communicating line connecting the first and second fuel supply conduits; and a joint part detachably connected to a distal end of the first fuel supply conduit and configured to communicate with a fuel hose, and wherein a distance between the throttle bores in the respective throttle bodies of the first throttle body group in the cylinder arrangement direction is less than a distance between the throttle bores of the respective throttle bodies of the second throttle body group in the cylinder arrangement direction.

2. The fuel supplying structure in a multi-cylinder engine as recited in claim 1, wherein the throttle bodies of the second throttle body group are connected together with a spacer interposed therebetween causing the distance between the throttle bores of the respective throttle bodies of the second throttle body group in the cylinder arrangement direction to be larger than the distance between the throttle bores of the respective throttle bodies of the first throttle body group.

3. The fuel supplying structure in a multi-cylinder engine as recited in claim 2, wherein:

each of the throttle bodies includes a respective throttle valve arranged inside a throttle bore thereof; and the fuel supplying structure further comprises a linkage mechanism which connects valve shafts of the throttle valves in the second throttle body group, and the linkage mechanism is disposed adjacent to the spacer between the throttle bodies of the second throttle body group.

4. The fuel supplying structure in a multi-cylinder engine as recited in claim 3, wherein the valve shafts of the respective throttle valves in the first throttle body group are linked together, and the fuel supplying structure further comprises a link connecting the linkage mechanism to the linked valve shafts of the throttle valves in the first throttle body group.

5. The fuel supplying structure in a multi-cylinder engine as recited in claim 1, wherein each of the throttle bodies includes a respective throttle valve arranged inside a throttle bore thereof, and an electric motor is placed in an end portion of the second throttle body group in the cylinder arrangement direction, for generating power to operate the throttle valves of at least the second throttle body group.

6. The fuel supplying structure in a multi-cylinder engine as recited in claim 5, wherein the joint part and the first fuel supply conduit are arranged proximate the first throttle body group, and wherein the electric motor for operating the throttle valves is arranged proximate the second throttle body group.

7. The fuel supplying structure in a multi-cylinder engine as recited in claim 1, wherein the joint part is detachably connected to the distal end of the first fuel supply conduit by an insertion/detachment operation in which the joint part is moved in a longitudinal direction of the first fuel supply conduit, and wherein the distal end of the first fuel supply conduit and the joint part are disposed outside of a range of the first side plate in order to allow for the insertion/detachment operation to occur without obstruction from the first side plate.

8. The fuel supplying structure in a multi-cylinder engine as recited in claim 1, wherein the communicating line connects the first and second fuel supply conduits to each other at respective middle portions thereof.

9. The fuel supplying structure in a multi-cylinder engine as recited in claim 1, wherein each of the throttle bodies includes a respective throttle valve arranged inside a throttle bore thereof, and an electric motor is placed in an end portion of the first throttle body group in the cylinder arrangement direction, for generating power to operate the throttle valves of at least the first throttle body group.

10. The fuel supplying structure in a multi-cylinder engine as recited in claim 1, further comprising:

a camshaft associated with each bank of the engine, respectively, and having a camshaft sprocket attached to one end thereof; and a throttle driving mechanism, comprising an electric motor disposed at a side of the engine substantially opposite the camshaft sprockets.

11. A multi-cylinder engine having first and second banks of cylinders arranged in a cylinder arrangement direction cooperating to define a V-shape, comprising:

first and second throttle body groups each including a plurality of throttle bodies arranged side-by-side in the cylinder arrangement direction with each of the throttle bodies including a throttle bore, and an operatively associated fuel injection valve, and wherein the throttle bodies are arranged such that a first distance in the cylinder arrangement direction between the throttle bodies of the first throttle body group is less than a second distance in the cylinder arrangement direction between the throttle bodies of the second throttle body group;

a first side plate extending in a perpendicular direction substantially perpendicular to the cylinder arrangement direction and abutting first ends of the first and second throttle body group;

a second side plate extending substantially parallel to the first side plate and abutting second ends of the first and second throttle body group; and a substantially H-shaped fuel supplying structure bounded in the cylinder arrangement direction by the first and second side plates and bounded in the perpendicular direction by the first and second throttle body groups, wherein the substantially H-shaped fuel supplying structure is configured to supply fuel to each of the fuel injection valves and includes:

first and second fuel supply conduits extending parallel to each other in the cylinder arrangement direction;

a communicating line connecting the first and second supply conduits;

a joint part detachably connected to a distal end of the first fuel supply conduit and configured to communicate with a fuel hose.

12. The multi-cylinder engine as, recited in claim 11, wherein the throttle bodies of the second throttle body group are connected together with a spacer interposed therebetween causing the distance between the throttle bores of the respective throttle bodies of the second throttle body group in the cylinder arrangement direction to be larger than the distance between the throttle bores of the respective throttle bodies of the first throttle body group.

13. The multi-cylinder engine as recited in claim 12, wherein:

each of the throttle bodies includes a respective throttle valve arranged inside a throttle bore thereof; and the fuel supplying structure further comprises a linkage mechanism which connects valve shafts of the throttle valves in the second throttle body group, and the linkage mechanism is disposed adjacent to the spacer between the throttle bodies of the second throttle body group.

14. The multi-cylinder engine as recited in claim 13, wherein:

the valve shafts of the respective throttle valves in the first throttle body group are linked together; and the fuel supplying structure further comprises a link connecting the linkage mechanism to the linked valve shafts of the throttle valves in the first throttle body group.

15. The multi-cylinder engine as recited in claim 11, wherein each of the throttle bodies includes a respective throttle valve arranged inside a throttle bore thereof, and an electric motor is placed in an end portion of the second throttle body group in the cylinder arrangement direction, for generating power to operate the throttle valves of at least the second throttle body group.

16. The multi-cylinder engine as recited in claim 15, wherein the joint part and the first fuel supply conduit are arranged proximate the first throttle body group, and wherein the electric motor for operating the throttle valves is arranged proximate the second throttle body group.

17. The multi-cylinder engine as recited in claim 11, wherein:

the joint part is detachably connected to the distal end of the first fuel supply conduit by an insertion/detachment operation in which the joint part is moved in a longitudinal direction of the first fuel supply conduit, and wherein the distal end of the first fuel supply conduit and the joint part are disposed outside of a range of the first side plate in order to allow for the insertion/detachment operation to occur without obstruction from the first side plate.

18. The multi-cylinder engine as recited in claim 11, wherein the communicating line connects the first and second fuel supply conduits to each other at respective middle portions thereof.

19. The multi-cylinder engine as recited in claim 11, wherein each of the throttle bodies includes a respective throttle valve arranged inside a throttle bore thereof, and an electric motor is placed in an end portion of the first throttle body group in the cylinder arrangement direction, for generating power to operate the throttle valves of at least the first throttle body group.

20. The multi-cylinder engine as recited in claim 11, further comprising:

a camshaft associated with each bank of the engine, respectively, and having a camshaft sprocket attached to one end thereof; and a throttle driving mechanism, comprising an electric motor disposed at a side of the engine substantially opposite the camshaft sprockets.

* * * * *